US005550356A

United States Patent [19]

Tripp et al.

[11] Patent Number: 5,550,356

[45] Date of Patent: Aug. 27, 1996

[54] FOOD COVERING DEVICE FOR USE WITH A MICROWAVE OVEN

[76] Inventors: Gregory A. Tripp, 10626 Hand Hwy., Onsted, Mich. 49265; Mitchell W. Michaluk, III, 17501 Mulvaney, Manchester, Mich. 48158

[21] Appl. No.: 262,922

[22] Filed: Jun. 20, 1994

[51] Int. Cl.[6] ..... H05B 6/80

[52] U.S. Cl. ..... 219/734; 219/756; 219/403; 219/729; 99/DIG. 14; 126/340; 126/220

[58] Field of Search ..... 219/756, 757, 219/752, 405, 403, 404, 762, 734, 735, 725, 729; 99/DIG. 14; 126/340, 220, 211, 217, 218, 237 R

[56] References Cited

U.S. PATENT DOCUMENTS

| | | | |
|---|---|---|---|
| 2,956,144 | 10/1960 | Woodman et al. | 219/746 |
| 3,275,799 | 9/1966 | Meltzer | 219/404 |
| 3,281,575 | 10/1966 | Ferguson, Jr. | 219/404 |
| 3,854,021 | 12/1974 | Moore et al. | 219/734 |
| 3,980,856 | 9/1976 | Allen et al. . | |
| 4,456,164 | 6/1984 | Foster et al. . | |
| 4,503,307 | 3/1985 | Campbell et al. . | |
| 4,762,973 | 8/1988 | Schultz | 219/746 |
| 4,871,892 | 10/1989 | Samford | 219/734 |
| 4,892,213 | 1/1990 | Mason, Jr. . | |
| 4,925,765 | 5/1990 | Madeleine . | |
| 4,980,529 | 12/1990 | Bolton | 219/752 |
| 5,028,754 | 7/1991 | Chiba | 219/735 |
| 5,126,520 | 6/1992 | Nottingham et al. . | |
| 5,241,150 | 8/1993 | Garvey et al. . | |

FOREIGN PATENT DOCUMENTS

| | | | |
|---|---|---|---|
| 52-74941 | 6/1977 | Japan | 219/734 |

*Primary Examiner*—Philip H. Leung

*Attorney, Agent, or Firm*—Gifford, Krass, Groh, Sprinkle, Patmore, Anderson & Citkowski, P.C.

[57] ABSTRACT

A food covering device for use with a microwave oven. The microwave oven has a door hingedly attached thereto and an interior which is defined by a top, sides and a bottom. The device includes a cover having a top and side wall which defines an open interior. The cover is suspended within the oven enclosure by a cord which attaches to the cover at one end and to the door of the oven at the other end. The cover is actuated from a first suspended position within the oven enclosure to a second position overlaying the bottom of the oven enclosure when the door is closed. A height adjuster is provided for adjusting the extent which the cover is actuated from the first to the second position. The cover overlays an item of food placed upon the bottom of the microwave interior when it is desirable to heat the item. The cover may also be adjusted solely at the height adjuster without the opening and closing motion of the door.

13 Claims, 2 Drawing Sheets

FOOD COVERING DEVICE FOR USE WITH A MICROWAVE OVEN

BACKGROUND OF THE INVENTION

1. Field of the Invention

The present invention relates generally to food covering devices and, more particularly, to a food covering device for use with a microwave oven.

2. Description of the Prior Art

Food covering devices are well known in the art, particularly covering devices used in microwave ovens. U.S. Pat. No. 4,892,213, issued to Mason, Jr., teaches a microwave cooking and serving dish. The cooking dish is constructed of top and bottom bowl sections, each section having a peripheral lip. A rim around the top bowl fits within a rim of the bottom bowl to secure the halves together. The bowl sets upon the base of the microwave enclosure and contains a desired product to be heated U.S. Pat. No. 3,980,856, issued to Allen et al., teaches a counterbalance linkage for a microwave oven door. The door is hingedly mounted along a top surface of the microwave and includes a spring biased linkage which maintains the door in an opened position.

SUMMARY OF THE PRESENT INVENTION

The present invention is a food covering device for use with a microwave oven. The microwave oven has an interior which is defined by a top, sides and a bottom. A door is hingedly attached to the oven and is selectively opened and closed to reveal the interior. The food covering device includes a cover which has a top and at least one side wall extending from the top to define a bowel-shaped enclosure. A cord attaches to the top of the cover at one end and to the microwave door at the other end and suspends the cover from a suspending member extending from the top of the microwave interior. The opening and closing of the microwave door selectively raises and lowers the cover from a first position suspended within the microwave interior to a second position adjacent to and overlaying the bottom of the interior. A height adjustment guide is secured to an inner surface of the microwave interior and receives the cord at a point intermediate the first end and the second end. A tab portion on the height adjustment guide receives an intermediate portion of the cord and adjusts the vertical distance which the cover is actuated during operation.

In a further preferred embodiment, the cord does not attach to the microwave door, but rather terminates at the height adjustment guide. The height of the cover may be manually adjusted by adjusting the tab portion of the height adjustment guide when the microwave door is open.

BRIEF DESCRIPTION OF THE DRAWING

Reference will now be made to the attached drawing, when read in conjunction with the following specification, wherein like reference numerals refer to like parts throughout the several views, and in which.

DESCRIPTION OF THE PREFERRED EMBODIMENTS

Figure 1:
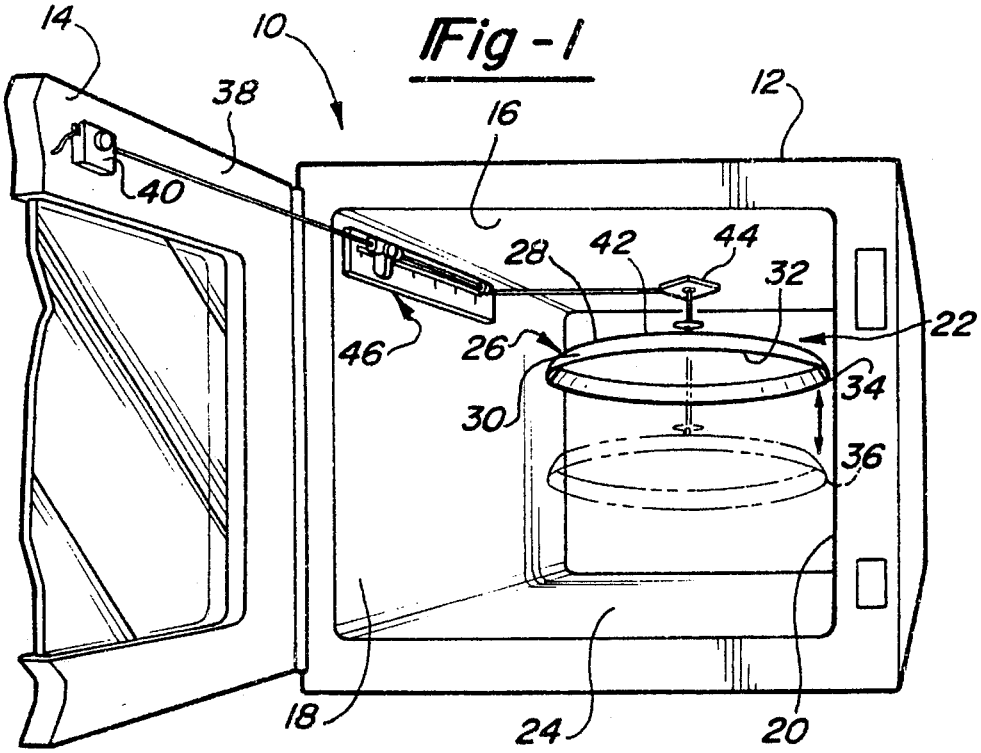
FIG. 1 is a perspective view of the food covering device of the present invention.

Referring to FIG. 1, a food covering device 10 for use with a microwave oven is shown. The microwave oven is of a type generally known in the art and is constructed of a body 12 having a door 14 which is hingedly connected thereto. An oven interior is formed within the body 12 and is defined by a top 16 sides 18, 20 and 22, and a bottom 24 The oven interior is revealed upon opening of the door 14 as is customarily known in the art.

Figure 5:
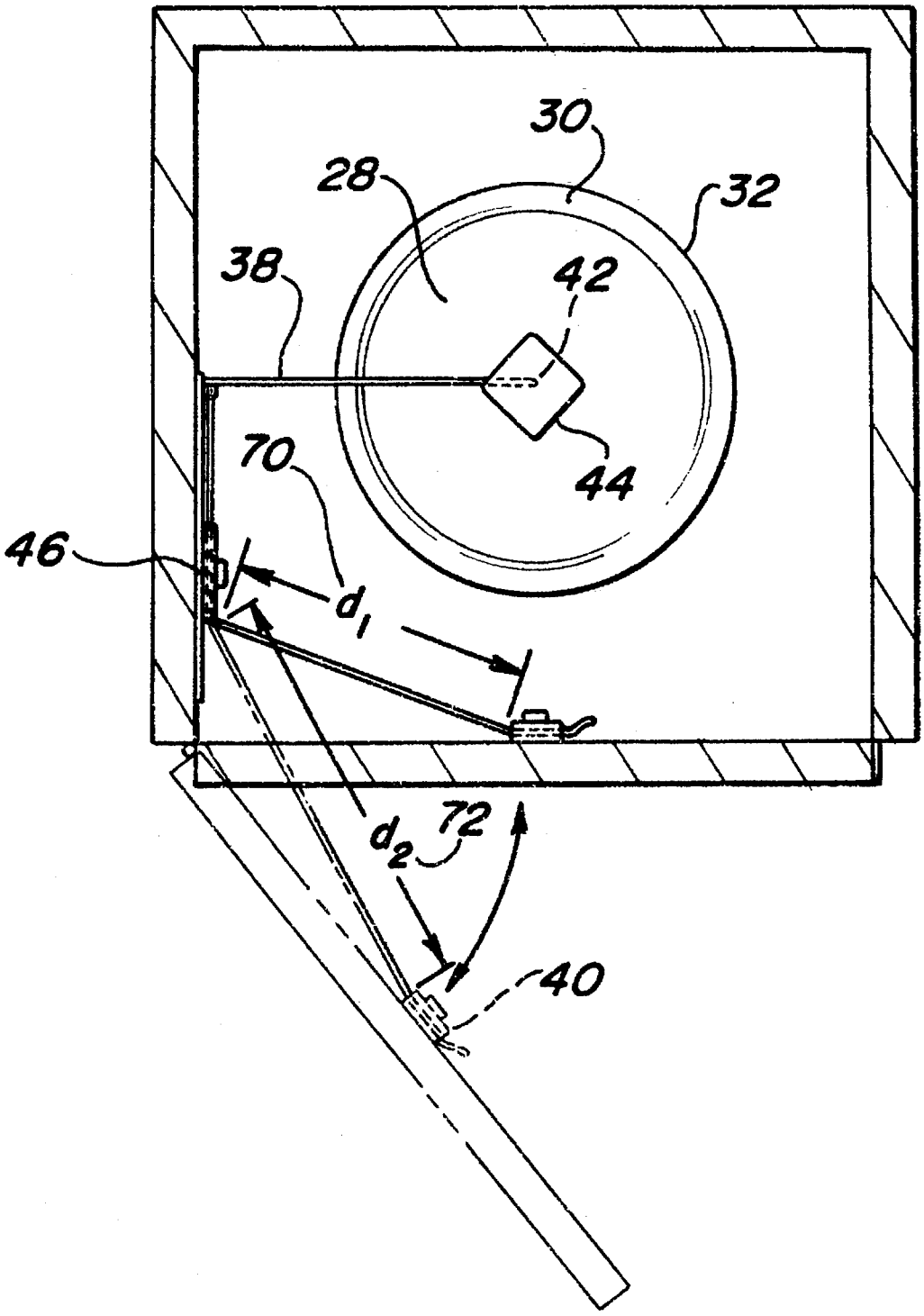
FIG. 5 is a top perspective of the view shown in FIG. 1 and illustrating the motion of the cord of the food covering device of the present invention.

A cover 26 is provided and is preferably constructed of a clear heat resistant plastic which enables the cover to withstand the heat generated within the microwave oven and to enable the user to see the food while it is being heated. The cover 26 is preferably circular in shape, having a top 28 and a continuous side wall 30 which extends from the top 28 and around the circumference of the cover 26 (see also FIG. 5) The side wall 30 may be outwardly flared as shown in FIG. 1 so as to establish a generally bowl-shaped enclosure space. A reinforced outer lip 32 is provided around the circumference of the cover 26 extending along the edge of the side wall 30 which ensures that the cover maintains a low center of gravity. The reinforced lip 32 also provides added surface area to the cover which enables the cover to hold more condensation produced by a food item to be heated. The cover may alternatively be shaped as a rectangle or some other polygon with a given number of side walls so long as it creates the desired enclosure.

Referring again to FIG. 1, an assembly is shown for actuating the cover from a first position 34 in which it is suspended within the oven interior to a second position 36 in which it is adjacent to and overlaying an item (not shown) placed upon the bottom 24 of the oven interior which is desired to be heated. The assembly includes a cord 38 constructed of a resilient and durable material and having a first end 40 and a second end 42. The first end 40 of the cord 38 is attached to an inside face of the microwave oven door 14 as shown in FIG. 1 and the second end 42 of the cord 38 is secured to the top 28 of the cover (see also FIG. 5).

A suspending member 44 is mounted to the top surface 16 of the oven interior. The suspending member 44 acts as a guide for the cord 38 and redirects the cord from a substantially horizontal direction to a vertically downward direction. The suspending member 44 can alternatively be a hook attached to an end of the cord and extending from the top surface of the oven interior. The hook may be dimensioned to engage and to balance the cover in a desired fashion within the oven interior. The cover is suspended from the suspending member 44 in its first position 34 as shown in solid in FIG. 1.

As will be described further on in the description, the pivoting motion of the door creates both upward and downward motion of the cover by affecting the length of cord which is established between the door and the suspending member. In this manner, the cover is actuated from the first position 34 in which it is suspended within the oven interior to the second position 36, shown in phantom in FIG. 1, in which it is substantially adjacent to and overlaying the item placed upon the bottom of the oven interior which is desired to be heated.

Figure 2:
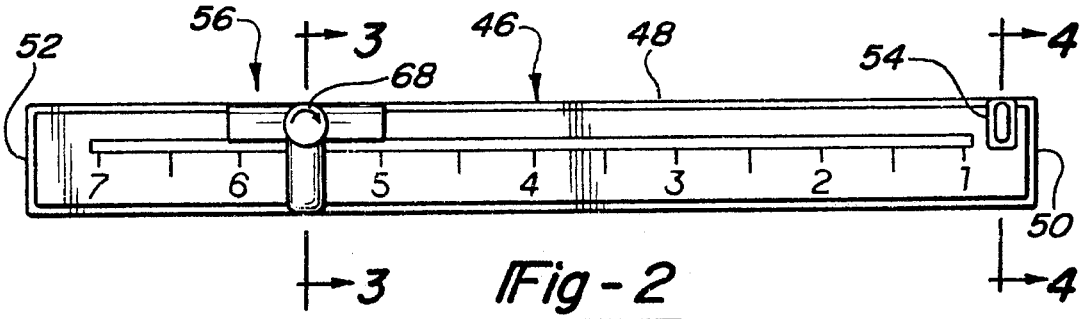
FIG. 2 is a sectional view of the height adjustment mechanism of the food covering device of the present invention.

Referring again to FIG. 1 and further to FIG. 2, a height adjuster 46 is mounted to the inner surface 18 of the microwave interior and adjusts the extent to which the cover is actuated from the first position 34 to the second position 36 upon the opening and closing of the microwave door 14. The height adjuster 46 preferably is in the shape of a scale or ruler and has an elongated body 48 with a first end 50 and a second end 52.

Figure 3:
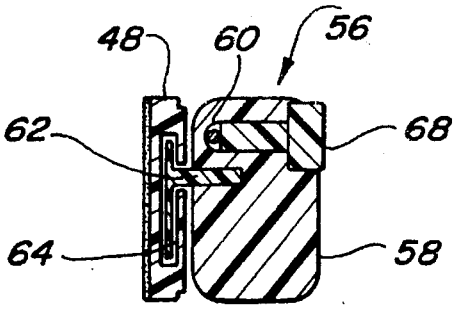
FIG. 3 is a cut-away view taken along lines 3—3 of FIG. 2 and showing the adjustable tab member of the food covering device of the present invention.
Figure 4:
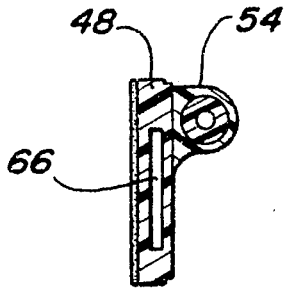
FIG. 4 is a cut-away view taken along lines 4—4 of FIG. 2 and showing the extending eyelet portion of the food covering device of the present invention.

Referring again to FIG. 2 and further to FIG. 4, an eyelet 54 extends from the body 48 of the height adjuster 46 at its first end 50. The eyelet defines a hollow sleeve through its interior through which the cord extends. Referring again to FIG. 2 and further to FIG. 3, a tab portion 56 is slidably mounted to the height adjuster body 48 and is adjustable along the length of the adjuster 46 between its first end 50 and its second end 52. The tab portion 56 has a tab body 58 which defines an internal channel 60 through which passes the cord 38.

The tab portion 56 has a mounting portion 62 extending therefrom. The mounting portion 62 has a planar end portion 64 attached to the mounting portion 62 which is slidably received within a longitudinally extending channel 66 formed within the height adjuster body 48 (see FIG. 4). The channel 66 extends the length of the height adjuster 46 and creates a slight resistance fit between the planar end portion 64 and the channel 66 such that the tab portion 56 may be slidably moved by the user but is not inadvertently moved by the weight of the cover 26 alone.

A locking screw 68 is threadably engaged with the tab portion 56 and is selectively rotated to either increase or decrease the area of the internal channel 60 through which the cord passes. The locking screw 68 can be tightened when the door 14 is open and the cover 26 in its first position 34 so that the shaft of the screw 68 decreases the area of channel 60 and pinches the cord 38. The cover 26 is therefore restrained upwardly and out of the way of the user should the user decide not to have the cover come down when the door 14 is closed.

Referring again to FIG. 5, the motion of the cord 38 between the first position and second position 36 of the cover 26 is shown. Specifically, a length of cord 70 (d1) is established when the microwave door 14 is closed. This length 70 is the length of cord 38 between the microwave door 14 and the tab portion 56 of the height adjuster 46 and corresponds substantially to the position 36 of the cover 26 as shown in FIG. 1. As the door 14 is pivotally opened, the length of cord 38 increases to a length 72 (d2). This length 72 corresponds to the position 34 of the cover in FIG. 1 and it is at this position that the locking screw 68 can be engaged to restrain the cover 26 out of the way.

Adjustment of the tab portion 56 along the length of the height adjuster 46 will change the established length of the cord 38 between the tab portion 56 and eyelet 54 and, consequently, the extent of the vertical drop of the cover 26 from the first position 34 to the second position. The distance of the tab portion from the eyelet 54 has a direct effect on the amount of cord 38 which translates through the suspending member 44 and which moves the cover up and down. The covering device can therefore be quickly and conveniently adjusted to cover 26 food items of varying height.

The covering device of the present invention can also be operated manually without the opening and closing of the microwave door 14. In this further preferred embodiment, the door is opened until the cover 26 reaches the top position 34. The height adjustment guide 46 is then moved to a position closest to the door 14 and the locking screw is tightened to lock the cord. The cord is then cut on the door side of the height adjustment guide 46 so as to leave enough cord 38 for future adjustment. The height of the cover 26 may then be adjusted by simply moving the adjuster toward the back of the oven 10 until the cover 26 moves down and reaches the desired height position over the food. The cover 26 may therefore be moved up and down at the height adjustment guide 46 without the opening and closing motion of the door 14.

Having described our invention, additional embodiments will become apparent to those skilled in the art to which it pertains without deviating from the scope of the inventor as defined in the appended claims.

We claim:

1. A food covering device for use with a microwave oven, the microwave oven having a door hingedly attached thereto revealing an interior of the oven, the interior being defined by a top, sides and a bottom, said device comprising:

a cover having a top and at least one side wall extending from said top to define an enclosure;

means for actuating said cover from a first elevated position above the bottom of the oven interior to a second lowered position adjacent to and overlaying the bottom of the oven interior, said enclosure of said cover overlying an item placed within the interior of the microwave oven, when said cover is in said second position;

said actuating means including a length of cord, a first end of said cord adapted to be attached to the door of the microwave oven and a second end of said cord being attached to said top of said cover;

a suspending member adapted to be secured to and extending from the top of the oven interior, said cord being engaged by said suspending member to suspend said cover between said first position and said second position; and an adjustment guide adapted to be mounted to the oven and receiving a portion of said length of cord, said adjustment guide being operable to adjust the position of said cover relative to the oven bottom between said first position and said second position.

2. The food covering device as described in claim 1, said adjustment guide comprising:

a first end and a second end;

an eyelet extending from said first end through which said cord extends; and a tab portion which is adjustable along a length of said adjustment guide between said first end and said second end, said cord extending through said tab portion to establish a length of cord between said tab portion and said eyelet.

3. The food covering device as described in claim 2, said tab portion further comprising a locking screw for locking in position said cord when said cover is in said first position.

4. The food covering device as described in claim 1, wherein said suspending member adapted to be positioned within said oven interior so that said cover is suspended substantially centrally within the oven interior.

5. The food covering device as described in claim 1, said first end of said cord being attached to said adjustment guide, said adjustment guide being secured to the door of the oven, said second end of said cord being attached to said top of said cover.

6. The food covering device as described in claim 5, wherein said adjustment guide further comprises a tab portion which is adjustable between a first end and a second end of said adjustment guide to actuate said cover from said first to said second position.

7. The food covering device as described in claim 1, wherein said cover is substantially circular in shape with an outwardly flared side wall.

8. The food covering device as described in claim 1, wherein said cover is substantially circular in shape and is constructed of a clear heat resistant plastic.

9. The food covering device as described in claim 1, wherein said cover further comprises a reinforced lip extending from said at least one side wall, said lip extending around a circumference of said cover.

10. A combination food covering device and microwave oven, comprising:

said microwave oven having a body and a door hingedly attached along an edge to said body, said body having an interior defined by a top, sides and a bottom;

a cover having a top and at least one side wall extending from said top to define an enclosure;

a length of cord, a first end of said cord being attached to said door of said oven and a second end of said cord being attached to said top of said cover;

a suspending member secured to and extending from said oven top, said cord being engaged by said suspending member to suspend said cover within said oven interior; and an adjustment guide mounted to a surface of said oven and receiving a portion of said length of cord, said adjustment guide being operable to adjust a height of said cover relative to said oven bottom;

said cover being actuated from a first elevated position above said oven bottom to a second lowered position overlaying a food item placed upon said oven bottom upon opening and closing of said oven door.

11. The combination food covering device and microwave oven as described in claim 10, further comprising said adjustment guide receiving an intermediate portion of said length of cord and mounting to one of said sides of said oven interior.

12. The combination food covering device and microwave oven as described in claim 11, said adjustment guide further comprising:

a first end and a second end;

an eyelet extending from said first end through which said cord extends; and a tab portion which is adjustable along a length of said adjustment guide between said first end and said second end, said cord extending through said tab portion and said eyelet.

13. The combination food covering device and microwave oven as described in claim 12, said tab portion further comprising a locking screw for locking in position said cord when said cover is in said first position.

* * * * *